US006795994B1

(12) United States Patent
Nahoom

(10) Patent No.: US 6,795,994 B1
(45) Date of Patent: Sep. 28, 2004

(54) PORTABLE CLEANING SYSTEM

(76) Inventor: Michael M. Nahoom, 6235 Thousand Oaks Dr., Lakeland, FL (US) 33813

( * ) Notice: Subject to any disclaimer, the term of this patent is extended or adjusted under 35 U.S.C. 154(b) by 58 days.

(21) Appl. No.: 10/043,608

(22) Filed: Jan. 9, 2002

(51) Int. Cl.[7] ..... A46B 13/04; A46B 11/02
(52) U.S. Cl. ..... 15/29; 15/24
(58) Field of Search ..... 15/24, 29

(56) References Cited

U.S. PATENT DOCUMENTS 1,636,437 A * 7/1927 Riedel ..... 15/29
2,232,493 A * 2/1941 Stuckey et al. ..... 15/22.1
2,806,236 A * 9/1957 Stefano ..... 15/29
4,417,826 A * 11/1983 Floros ..... 401/41

* cited by examiner

*Primary Examiner*—Robert J. Warden, Sr.
*Assistant Examiner*—S Balsis

(57) ABSTRACT

A portable cleaning system a power pack assembly, a combination hose/electrical wiring assembly, and a motorized power transfer assembly brush assembly. The power pack assembly includes a rechargeable battery power supply and is connected to the motorized power transfer assembly brush assembly using the combination hose/electrical wiring assembly. The user may attach a variety of items for cleaning, polishing and the like to the electrical motor driven rotary, tool attachment plate of the motorized power transfer assembly brush assembly.

1 Claim, 3 Drawing Sheets

PORTABLE CLEANING SYSTEM

TECHNICAL FIELD

The present invention relates to cleaning systems and more particularly to an improved portable cleaning system that includes a power pack assembly, a combination hose/electrical wiring assembly, and a motorized power transfer assembly brush assembly; the power pack assembly including a rechargeable battery power supply having a wall outlet attachable charging system including a wall outlet plug, a power cord, an AC to DC converter, and a charging regulator circuit having the circuit outputs thereof in connection with the positive and negative battery terminals of a rechargeable battery; a rechargeable battery having positive and negative terminals each in connection with a respective positive and negative socket of a power supply connector plug of the two conductor wiring assembly; the two conductor wiring assembly including two electrical conductors mechanically connected to the exterior side of the hose along a portion thereof terminating in a two pronged transfer assembly plug that mates with a power supply coupling provided on the power transfer assembly housing; the power pack assembly including a water flow control valve in connection between an inlet hose fitting and an outlet hose fitting to allow water flow to the hose portion of the combination hose/electrical wiring assembly; the motorized power transfer assembly brush assembly including a power transfer assembly housing having a soap reservoir defined therein; a power supply coupling provided on the power transfer assembly housing and in electrical connection with an electric drive motor provided within the power transfer assembly housing through a trigger-type electrical drive motor control switch; a hose coupling in connection with a water distribution manifold connected to a number of shower spray holes provided around the bottom perimeter of the power transfer assembly housing; a removable, brush head detachably attached to a rotary, tool attachment plate having a back side connected to the shaft of the electric drive motor and an outward facing side provided with an attachment fastener for allowing attachment of a variety of items for cleaning, polishing and the like; a soap dispenser button controlling a valve between the water distribution manifold and the soap reservoir; a clear water rinse button controlling a valve between the hose coupling and the number of shower spray holes through the water distribution manifold, a chemical concentration viewing window in connection with the water distribution manifold so as to allow a user to determine the concentration of soap to water before the soap/water mixture is sprayed out of the shower spray holes; a fill aperture assembly provided on the exterior of the power transfer assembly housing with a fill aperture fitting having a fill hole in connection with the soap reservoir and a sealing cap securable to the fill aperture fitting to seal the fill hole; a curved, easy-grip handle having two handle ends each secured to the exterior of the power transfer assembly housing; the trigger-type electrical drive motor control switch, the soap dispenser button, the clear water rinse button, and the chemical concentration viewing window being conveniently provided on the curved, easy-grip handle.

BACKGROUND ART

It is often difficult to clean a surface such as the exterior of a vehicle, shower, bathtub, or the like because of the amount of scrubbing required to remove built-up layers of dirt and grime. It would be desirable, therefore, to have a portable cleaning system that was battery powered and which included a motor-driven brush and/or other cleaning head assemblies for allowing a user to rapidly remove the built-up layers of dirt and grime. The portable cleaning system would preferably be attached to a water source and contain a cleaning fluid reservoir to allow a user to dispense cleaning fluids easily where needed and a mechanism to allow the user to rapidly rinse off any dirt or cleaning fluid as needed.

GENERAL SUMMARY DISCUSSION OF INVENTION

It is thus an object of the invention to provide an improved portable cleaning system that includes a power pack assembly, a combination hose/electrical wiring assembly, and a motorized power transfer assembly brush assembly; the power pack assembly including a rechargeable battery power supply having a wall outlet attachable charging system including a wall outlet plug, a power cord, an AC to DC converter, and a charging regulator circuit having the circuit outputs thereof in connection with the positive and negative battery terminals of a rechargeable battery; a rechargeable battery having positive and negative terminals each in connection with a respective positive and negative socket of a power supply connector plug of the two conductor wiring assembly; the two conductor wiring assembly including two electrical conductors mechanically connected to the exterior side of the hose along a portion thereof terminating in a two pronged transfer assembly plug that mates with a power supply coupling provided on the power transfer assembly housing; the power pack assembly including a water flow control valve in connection between an inlet hose fitting and an outlet hose fitting to allow water flow to the hose portion of the combination hose/electrical wiring assembly; the motorized power transfer assembly brush assembly including a power transfer assembly housing having a soap reservoir defined therein; a power supply coupling provided on the power transfer assembly housing and in electrical connection with an electric drive motor provided within the power transfer assembly housing through a trigger-type electrical drive motor control switch; a hose coupling in connection with a water distribution manifold connected to a number of shower spray holes provided around the bottom perimeter of the power transfer assembly housing; a removable, brush head detachably attached to a rotary, tool attachment plate having a back side connected to the shaft of the electric drive motor and an outward facing side provided with an attachment fastener for allowing attachment of a variety of items for cleaning, polishing and the like; a soap dispenser button controlling a valve between the water distribution manifold and the soap reservoir; a clear water rinse button controlling a valve between the hose coupling and the number of shower spray holes through the water distribution manifold, a chemical concentration viewing window in connection with the water distribution manifold so as to allow a user to determine the concentration of soap to water before the soap/water mixture is sprayed out of the shower spray holes; a fill aperture assembly provided on the exterior of the power transfer assembly housing with a fill aperture fitting having a fill hole in connection with the soap reservoir and a sealing cap securable to the fill aperture fitting to seal the fill hole; a curved, easy-grip handle having two handle ends each secured to the exterior of the power transfer assembly housing; the trigger-type electrical drive motor control switch, the soap dispenser button, the clear water rinse button, and the chemical concentration viewing window being conveniently provided on the curved, easy-grip handle.

Accordingly, an improved portable cleaning system is provided. The improved portable cleaning system includes a power pack assembly, a combination hose/electrical wiring assembly, and a motorized power transfer assembly brush assembly; the power pack assembly including a rechargeable battery power supply having a wall outlet attachable charging system including a wall outlet plug, a power cord, an AC to DC converter, and a charging regulator circuit having the circuit outputs thereof in connection with the positive and negative battery terminals of a rechargeable battery; a rechargeable battery having positive and negative terminals each in connection with a respective positive and negative socket of a power supply connector plug of the two conductor wiring assembly; the two conductor wiring assembly including two electrical conductors mechanically connected to the exterior side of the hose along a portion thereof terminating in a two pronged transfer assembly plug that mates with a power supply coupling provided on the power transfer assembly housing; the power pack assembly including a water flow control valve in connection between an inlet hose fitting and an outlet hose fitting to allow water flow to the hose portion of the combination hose/electrical wiring assembly; the motorized power transfer assembly brush assembly including a power transfer assembly housing having a soap reservoir defined therein; a power supply coupling provided on the power transfer assembly housing and in electrical connection with an electric drive motor provided within the power transfer assembly housing through a trigger-type electrical drive motor control switch; a hose coupling in connection with a water distribution manifold connected to a number of shower spray holes provided around the bottom perimeter of the power transfer assembly housing; a removable, brush head detachably attached to a rotary, tool attachment plate having a back side connected to the shaft of the electric drive motor and an outward facing side provided with an attachment fastener for allowing attachment of a variety of items for cleaning, polishing and the like; a soap dispenser button controlling a valve between the water distribution manifold and the soap reservoir; a clear water rinse button controlling a valve between the hose coupling and the number of shower spray holes through the water distribution manifold, a chemical concentration viewing window in connection with the water distribution manifold so as to allow a user to determine the concentration of soap to water before the soap/water mixture is sprayed out of the shower spray holes; a fill aperture assembly provided on the exterior of the power transfer assembly housing with a fill aperture fitting having a fill hole in connection with the soap reservoir and a sealing cap securable to the fill aperture fitting to seal the fill hole; a curved, easy-grip handle having two handle ends each secured to the exterior of the power transfer assembly housing;

the trigger-type electrical drive motor control switch, the soap dispenser button, the clear water rinse button, and the chemical concentration viewing window being conveniently provided on the curved, easy-grip handle.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
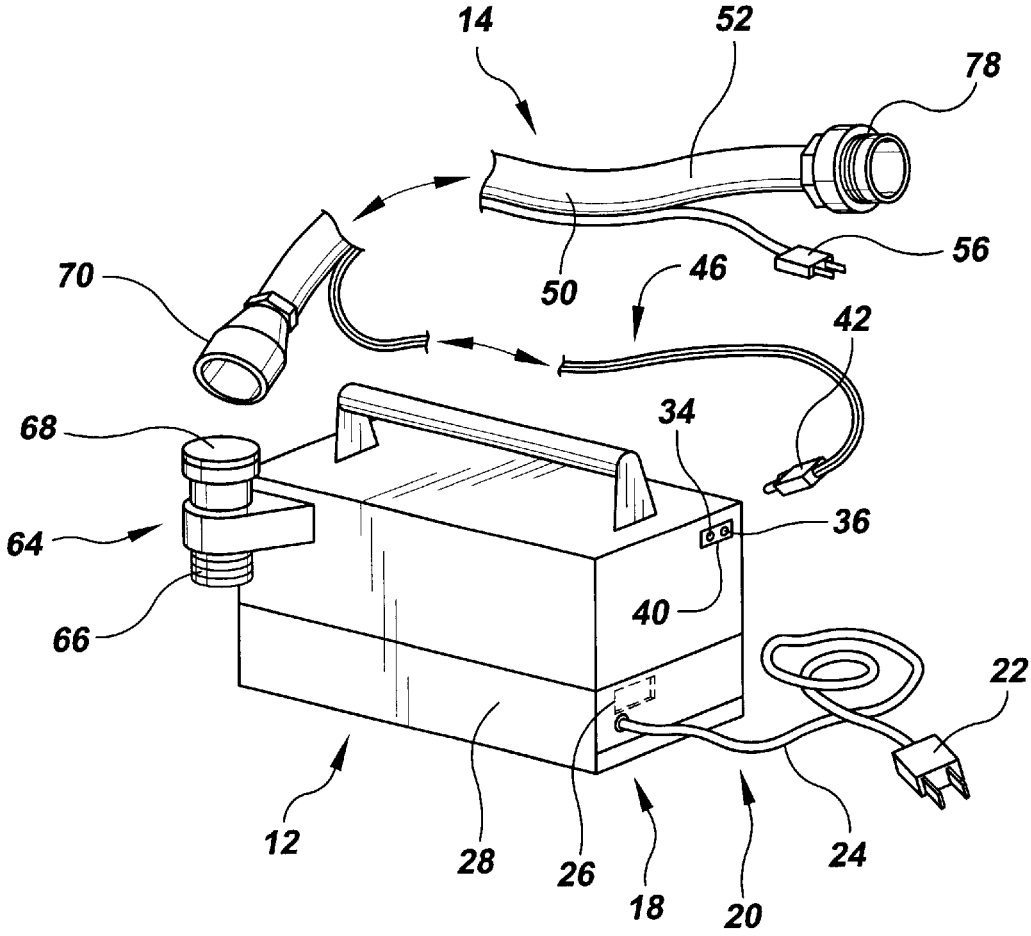
FIG. 1 is a perspective view of an exemplary embodiment of the power pack assembly of the present invention along with the combination hose/electrical wiring assembly which is utilized for connecting the power pack assembly to the motorized power transfer assembly brush assembly of the improved portable cleaning system of the present invention; the power pack assembly including a rechargeable battery power supply having a wall outlet attachable charging system including a wall outlet plug, a power cord, an AC to DC converter, and a charging regulator circuit having the circuit outputs thereof in connection with the positive and negative battery terminals of a rechargeable battery; a rechargeable battery having positive and negative terminals each in connection with a respective positive and negative socket of a power supply connector plug of the two conductor wiring assembly; the two conductor wiring assembly including two electrical conductors mechanically connected to the exterior side of the hose along a portion thereof terminating in a two pronged transfer assembly plug that mates with a power supply coupling provided on the power transfer assembly housing; the power pack assembly including a water flow control valve in connection between an inlet hose fitting and an outlet hose fitting to allow water flow to the hose portion of the combination hose/electrical wiring assembly.
Figure 2:
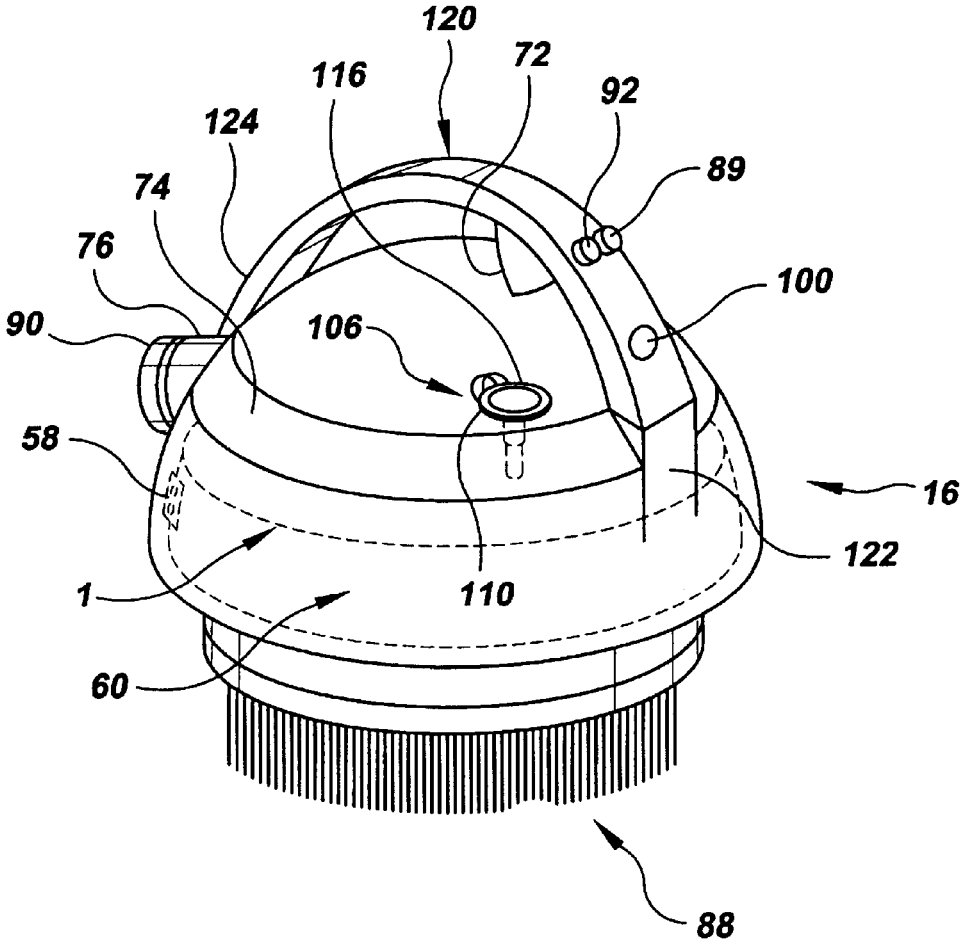
FIG. 2 is a perspective view of the motorized power transfer assembly brush assembly including a power transfer assembly housing having a soap reservoir defined therein; a power supply coupling provided on the power transfer assembly housing and in electrical connection with an electric drive motor provided within the power transfer assembly housing through a trigger-type electrical drive motor control switch; a hose coupling in connection with a water distribution manifold connected to a number of shower spray holes provided around the bottom perimeter of the power transfer assembly housing; a removable, brush head detachably attached to a rotary, tool attachment plate having a back side connected to the shaft of the electric drive motor and an outward facing side provided with an attachment fastener for allowing attachment of a variety of items for cleaning, polishing and the like; a soap dispenser button controlling a valve between the water distribution manifold and the soap reservoir; a clear water rinse button controlling a valve between the hose coupling and the number of shower spray holes through the water distribution manifold, a chemical concentration viewing window in connection with the water distribution manifold so as to allow a user to determine the concentration of soap to water before the soap/water mixture is sprayed out of the shower spray holes; a fill aperture assembly provided on the exterior of the power transfer assembly housing with a fill aperture fitting having a fill hole in connection with the soap reservoir and a sealing cap securable to the fill aperture fitting to seal the fill hole; a curved, easy-grip handle having two handle ends each secured to the exterior of the power transfer assembly housing; the trigger-type electrical drive motor control switch, the soap dispenser button, the clear water rinse button, and the chemical concentration viewing window being conveniently provided on the curved, easy-grip handle.
Figure 3:
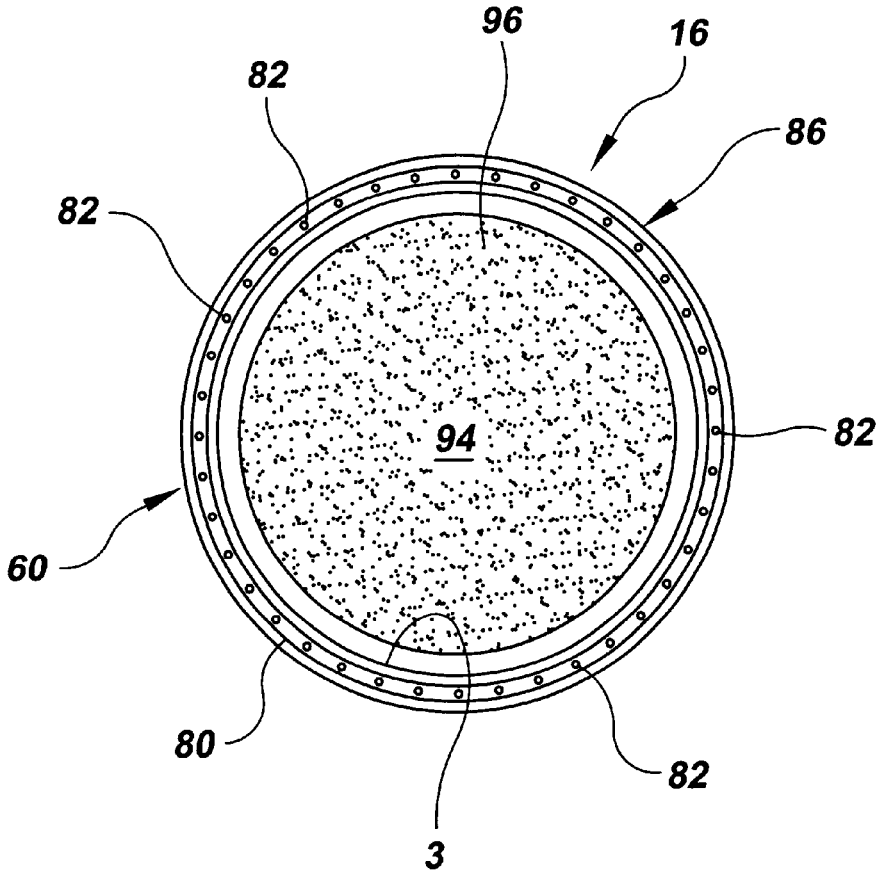
FIG. 3 is a bottom plan view of the motorized power transfer assembly brush assembly showing the number of shower spray holes provided around the bottom perimeter of the power transfer assembly housing; and the rotary, tool attachment plate with the detachable brush head removed to show the attachment fastener provided thereon for allowing attachment of a variety of items for cleaning, polishing and the like to the rotary, tool attachment plate.

FIGS. 1–3 show various aspects of an exemplary embodiment of the improved portable cleaning system of the present invention. Improved portable cleaning system 10 includes a power pack assembly, generally designated 12; a combination hose/electrical wiring assembly, generally designated 14; and a motorized power transfer assembly brush assembly, generally designated 16.

Power pack assembly 12 includes a rechargeable battery power supply, generally designated 18 having a wall outlet attachable charging system, generally designated 20, including a wall outlet plug 22, a power cord 24, an AC to DC converter 26, and a charging regulator circuit 28 having the circuit outputs thereof in connection with the positive and negative battery terminals 34,36 of rechargeable battery power supply 18.

Positive and negative terminals 34,36 of rechargeable battery power supply 18 are each in connection with a respective positive and negative socket, generally designated 40, that mates with a power supply connector plug, generally designated 42 of a two conductor wiring assembly, generally designated 46. Two conductor wiring assembly 46 includes two electrical conductors mechanically connected to the exterior side 50 of the hose 52 along a portion thereof terminating in a two pronged transfer assembly plug 56 that mates with a power supply coupling 58 provided on a power transfer assembly housing, generally designated 60.

Power pack assembly 12 also includes a water flow control valve, generally designated 64, in connection between an inlet hose fitting 66 and an outlet hose fitting 68 to allow water flow to the power pack connecting end fitting 70 of hose 50 of the combination hose/electrical wiring assembly 14.

Motorized power transfer assembly brush assembly 16 includes a power transfer assembly housing 60 having a soap reservoir, generally designated 74, defined therein; a power supply coupling 58 provided on the power transfer assembly housing 60 and in electrical connection with an electric drive motor 1 (shown in dashed lines) provided within power transfer assembly housing 60 through a trigger-type electrical drive motor control switch 72; a hose coupling 76 is provided for connecting the scrub assembly end fitting 78 of hose 50 in connection with a water distribution manifold, generally designated 80 (shown in dashed lines) connected to a number of spaced shower spray holes 82 provided around the bottom perimeter, generally designated 86, of power transfer assembly housing 60.

A removable, brush head, generally designated 88, is detachably attached to a rotary, tool attachment plate, generally designated 3, having a back side connected to the shaft of electric drive motor 1 and an outward facing side 94 covered with hook and pile fastener material 96 to allow a user to a variety of items for cleaning, polishing and the like.

Motorized power transfer assembly brush assembly 16 also includes a soap dispenser button, generally designated 89, controlling a valve between the water distribution manifold 80 and the soap reservoir 74; a clear water rinse button, generally designated 92, controlling a valve between the hose coupling 90 and the number of shower spray holes 82 through the water distribution manifold 80, a chemical concentration viewing window, generally designated 100, in connection with the water distribution manifold 80 so as to allow a user to determine the concentration of soap to water before the soap/water mixture is sprayed out of the shower spray holes 82.

A fill aperture assembly, generally designated 106, is provided on the exterior of the power transfer assembly housing 60 with a fill aperture in connection with the soap reservoir 70 and a sealing cap 116 securable to the fill aperture to seal the fill hole 110. A curved, easy-grip handle, generally designated 120, having two handle ends 122,124, each secured to the exterior of the power transfer assembly housing 60 is also provided.

Trigger-type electrical drive motor control switch 72, the soap dispenser button 89, the clear water rinse button 92, and the chemical concentration viewing window 100 are conveniently provided on the curved, easy-grip handle 120.

It can be seen from the preceding description that an improved portable cleaning system has been provided.

It is noted that the embodiment of the improved portable cleaning system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An improved portable cleaning system comprising:

a power pack assembly;

a combination hose/electrical wiring assembly; and a motorized power transfer assembly brush assembly;

the power pack assembly including a rechargeable battery power supply having a wall outlet attachable charging system including a wall outlet plug, a power cord, an AC to DC converter, and a charging regulator circuit having the circuit outputs thereof in connection with the positive and negative battery terminals of a rechargeable battery;

a rechargeable battery having positive and negative terminals each in connection with a respective positive and negative socket of a power supply connector plug of the two conductor wiring assembly;

the two conductor wiring assembly including two electrical conductors mechanically connected to the exterior side of the hose along a portion thereof terminating in a two pronged transfer assembly plug that mates with a power supply coupling provided on the power transfer assembly housing;

the power pack assembly including a water flow control valve in connection between an inlet hose fitting and an outlet hose fitting to allow water flow to the hose portion of the combination hose/electrical wiring assembly;

the motorized power transfer assembly brush assembly including a power transfer assembly housing having a soap reservoir defined therein;

a power supply coupling provided on the power transfer assembly housing and in electrical connection with an electric drive motor provided within the power transfer assembly housing through a trigger-type electrical drive motor control switch;

a hose coupling in connection with a water distribution manifold connected to a number of shower spray holes provided around the bottom perimeter of the power transfer assembly housing;

a removable, brush head detachably attached to a rotary, tool attachment plate having a back side connected to the shaft of the electric drive motor and an outward facing side provided with an attachment fastener for allowing attachment of a variety of items for cleaning, polishing and the like;

a soap dispenser button controlling a valve between the water distribution manifold and the soap reservoir;

a clear water rinse button controlling a valve between the hose coupling and the number of shower spray holes through the water distribution manifold, a chemical concentration viewing window in connection with the water distribution manifold so as to allow a user to determine the concentration of soap to water before the soap/water mixture is sprayed out of the shower spray holes;

a fill aperture assembly provided on the exterior of the power transfer assembly housing with a fill aperture fitting having a fill hole in connection with the soap reservoir and a sealing cap securable to the fill aperture fitting to seal the fill hole;

a curved, easy-grip handle having two handle ends each secured to the exterior of the power transfer assembly housing;

the trigger-type electrical drive motor control switch, the soap dispenser button, the clear water rinse button, and the chemical concentration viewing window being conveniently provided on the curved, easy-grip handle.

* * * * *